US005573158A

United States Patent [19]

Penn

[11] Patent Number: 5,573,158

[45] Date of Patent: Nov. 12, 1996

[54] SPINNING DRUM CARRIER

[76] Inventor: Henry A. Penn, 305 Weldon Rd., Brandenburg, Ky. 40108

[21] Appl. No.: 380,365

[22] Filed: Jan. 30, 1995

Related U.S. Application Data

[63] Continuation-in-part of Ser. No. 13,805, Oct. 4, 1993, Pat. No. Des. 354,975.

[51] Int. Cl.[6] ..... A45F 3/10

[52] U.S. Cl. ..... 224/265; 224/197; 224/910; 84/421

[58] Field of Search ..... 224/910, 265, 224/266, 197, 259, 260, 261, 262, 209, 210, 211; 84/421; D17/22, 99

[56] References Cited

U.S. PATENT DOCUMENTS

| | | | |
|---|---|---|---|
| 2,854,880 | 10/1958 | Waters . | |
| 3,106,123 | 1/1962 | Johannsen . | |
| 4,387,839 | 6/1983 | Dranchak . | |
| 4,450,993 | 5/1984 | Ephraim | 224/910 |
| 4,453,442 | 6/1984 | LaFlame . | |
| 4,605,144 | 8/1986 | LaFlame . | |
| 4,634,032 | 1/1987 | LaFlame . | |
| 4,799,610 | 1/1989 | Hsieh . | |
| 5,060,836 | 10/1991 | Bradford et al. | 224/910 |
| 5,400,683 | 3/1995 | LaFlame | 224/910 |

*Primary Examiner*—Henry J. Recla
*Assistant Examiner*—Gregory M. Vidovich
*Attorney, Agent, or Firm*—Middleton & Reutlinger; David W. Carrithers

[57] ABSTRACT

A spinning drum carrier having a carrier frame including a curved abdomen support plate attached to a vertical support member which is curved inwardly slightly at the bottom end toward the wearer. The top of the vertical support member is angled inwardly at the top end toward the wearer and removably and adjustably attached to a pair of shoulder strap support members fitting over the shoulders of the user to support the frame and drum. The drum is removably and adjustably attached to an "I-shaped" drum support frame including a longitudinal main member having a straight center section and angled end portions for extending outwardly away from the user to facilitate the curvature of the drum. A pair of spaced apart drum holding members are mounted normal to the distal ends of the main member. Adjustable drum attachment means, such as rotating swivel hooks extend from the distal ends of the drum holding members to the drum rims. Coaxial bushings, a single row radial baring, roller bearings, or preferably a double roll angular contact sealed bearing rotatably connects the drum support frame with the carrier frame. A latching mechanism mounted on the drum support frame provide a means to hold the drum in a rigid stationary manner in a desired position or secure the drum from spinning.

20 Claims, 8 Drawing Sheets

SPINNING DRUM CARRIER

BACKGROUND OF THE INVENTION

This application is a Continuation-In-Part of U.S. Patent Ser. No. 13,805, filed Oct. 4, 1993, now U.S. Pat. No. D354,975 which issued on Jan. 31, 1995.

The spinning drum carrier of the present invention is designed for use by a member of a marching band, such as a high school, college, or military ban, for carrying various types of drums. Typical drum carriers provide for holding the drum stationary, vertically positioned with respect to the ground.

Marching band competition is very dependent upon visual effects. Therefore, the instant invention comprises a spinning drum carrier for various drums such as a base drum and permit playing the drum in a vertical position, whereby the drum heads are vertical with respect to the ground; in a horizontal position with the drum heads horizontal to the ground; or even various other positions, even at an angle. Moreover, images, messages, or even lights may be printed on the head or rim of the drum so that spinning the drum creates special visual effects.

Furthermore the spinning drum carrier is fabricated from flat bar stock to provide the appearance of a slim profile and to fit close to the wearer's body in contrast to the cumbersome and awkward profile of conventional drum carriers.

SUMMARY OF THE INVENTION

The spinning drum carrier of the present invention comprises a carrier frame having a curved abdomen support removably and adjustably attached to a vertical support member having a straight center section being curved inwardly slightly at the bottom and angled inwardly at the top toward the wearer to provide maximum clearance of the drum from the user. A lateral support bar is removably and adjustably attached to the upper end of the vertical support member at its center for removably and adjustably attaching a pair of shoulder straps spaced apart from one another a distance to accommodate the users neck and for resting on the shoulders of the user to support the frame and drum held therein.

The drum is removably attached to a drum support frame comprising a longitudinal main member having angled end portions extending outwardly away from the user to facilitate the curvature of the drum. Lateral drum holding members having a selected length are mounted normal to the axis on each end of the longitudinal main member. Drum attachment means, such as adjustable removable pivoting or rotating swivel hooks or knob clamps extend outwardly from the lateral drum holding member to the rim of the drum.

A spindle assembly comprising a coaxial bushings, a single row radial baring, roller bearings, or preferably a double roll angular contact sealed bearing rotatably connects the drum support frame with the carrier frame. Preferably, a double roll angular contact sealed bearing rotatably connects the center of the drum support frame with the center of the vertical support member of the carrier frame. Although a single bearing or bushing may be used, they wear fast and do not provide the close tolerance necessary to support the weight of the drum. It is essential that any "play" be eliminated in the bearing to provide the necessary control over the drum when spinning the drum on the axis. The main body of the bearing extends outward away from the user on the exterior portion of the drum support frame. The spindle of the bearing extends inwardly through the longitudinal main member of the drum support frame to the vertical support member of the carrier frame. The length of the bearing assembly and spindle are selected to provide maximum support and position the drum at the appropriate position away from the user.

A clamping or latching mechanism mounted on the drum support frame provide a means to hold the drum in a rigid stationary manner in a desired position or secure the drum from spinning. The clamping mechanism comprises a latch support assembly having a pair of spaced apart flanges or tabs for holding the drum motionless during routine use. The flanges are attached to a rod or spindle having a plurality of shallow recesses or notches formed at selected positions which mate with spring loaded ball bearings or plungers such as veliers in the latch attachment housing. The latch assembly is unique in that it uses a rachet ball/recess means for holding the flanges in the correct up or down position as the spindle is rotated within the latch attachment housing.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

Figure 1:
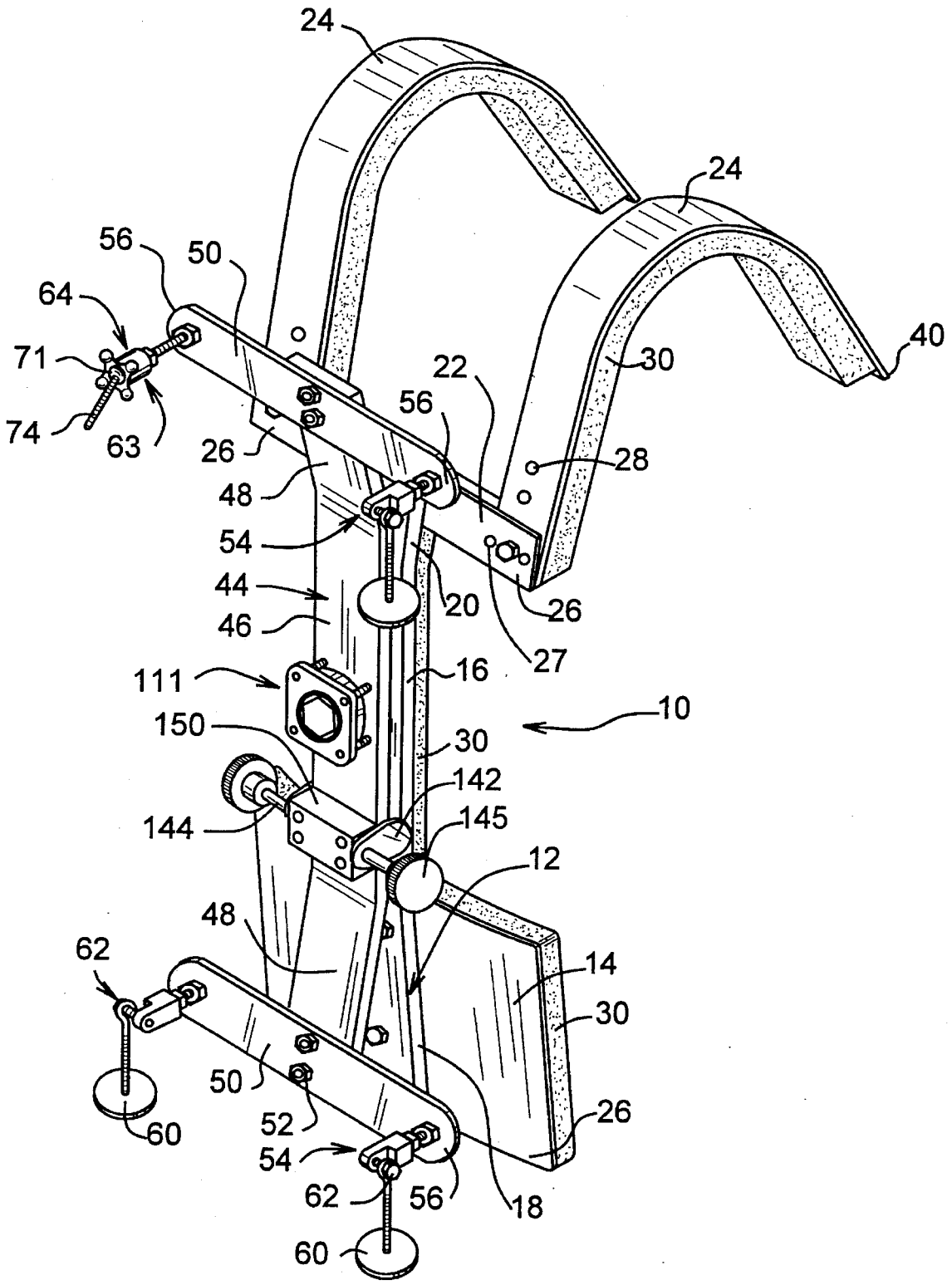
FIG. 1 is a perspective view of the present invention showing the spinning drum carrier including a carrier frame, drum support frame, spindle assembly and latch mechanism.
Figure 2:
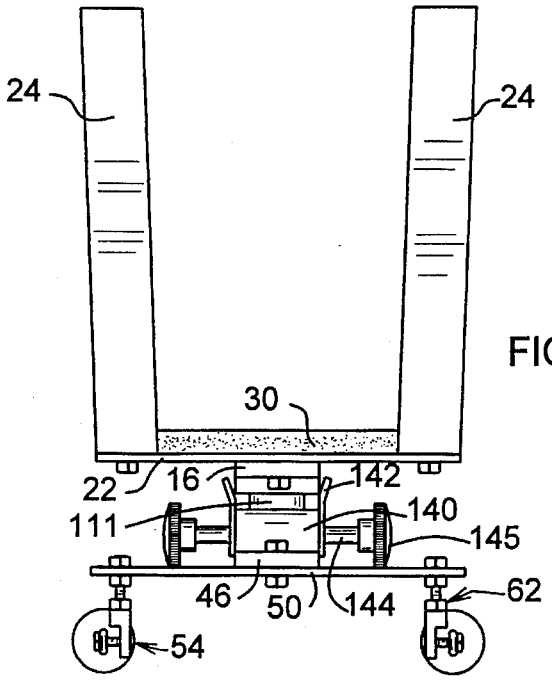
FIG. 2 is a top plan view of the spinning drum carrier of FIG. 1.

The spinning drum carrier of the present invention is manufactured from readily available materials and simple in design. The preferred embodiment is comprised of metal, more particularly aluminum due to its light weight and great structural strength. However, it is contemplated that plastic, such as high density polyethylene, nylon, PVC, fiberglass, wood, a polymer composite containing graphite or aramid fibers, or any type of metal such as steel or copper could be used in combination with or substituted for the aluminum components of the present invention.

Referring now to the drawings, FIGS. 1–9 show the spinning drum carrier of the preferred embodiment.

The spinning drum carrier 10 of the instant invention includes a generally "T-shaped" carrier frame 12 including an abdomen support plate 14 attached to a vertical support member 16 which is curved inwardly slightly at the bottom end 18 toward the wearer. The top end 20 of the vertical support member 16 is angled inwardly toward the wearer. A lateral support bar 22 consisting of a short, straight aluminum strip is removably and adjustably attached at its center to the top end 20 of the vertical support member 16. A rigid pair of curved shoulder straps 24 formed of aluminum bar stock are removably and adjustably attached to each end 26 of the lateral support bar 22 and spaced apart from one another for extending on either side of the wearer's neck, over the upper part of the chest and over the wearer's shoulders.

In the preferred embodiment the vertical support member 16, abdomen plate 14, and lateral support bar 16 have a plurality of holes 27 formed therein, whereby fastening is accomplished by aligning and bolting the abdomen plate 14 and lateral bar 22 to the vertical support member 16 at a selected position, moreover, the shoulder straps 24 are bolted to the lateral support member 22 at a selected position in the same manner; however, it is contemplated that the entire assembly or any parts thereof can be formed integrally such as by an injection molding process or welding.

Furthermore, the portions of the carrier frame 12 which come in contact with the wearer are covered by a soft, cushioning material 30 such as foam rubber or other soft pliable rubber or polymeric material which may be attached to the surface of the carrier frame by an adhesive such as glue, snaps, or hook and loop fasteners, such as VELCRO™ strips. Thus a cushioning material 30 covers the inner surface 32 of the abdomen plate 14, the inner surface 34 of the vertical support member, the inner surface 36 of the lateral support 22, and the inner surface 38 of the shoulder straps 24. It is contemplated that portions of the carrier frame may also be covered in cushioning material such as tubular lined sleeves to fit over the straps 24.

Figure 3:
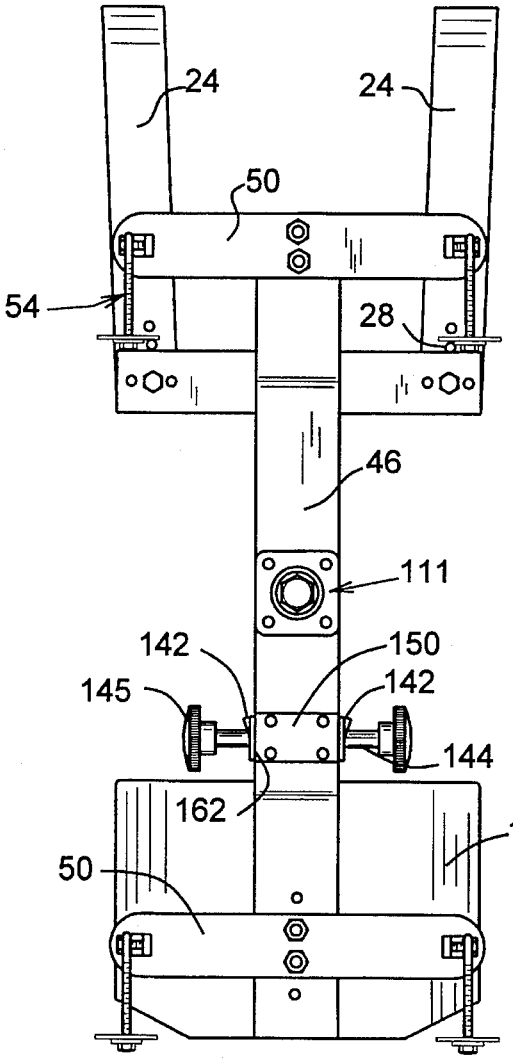
FIG. 3 is front elevational view spinning drum carrier of FIG. 1.

An improved feature of the present invention is the abdomen support plate 14 which is curved inwardly slightly along the horizontal axis to fit around the wearer's midsection comfortably and for maximizing support therefrom. As shown in FIGS. 1 and 3, the abdomen support 14 may be formed in various shapes such as square, elliptical, rectangular as shown in FIG. 1, or any other desired shape; however, the preferred embodiment utilizes a generally rectangular shaped plate having the corners 26 cut off at the bottom so as to provide the maximum support possible and still not interfere with the wearer's upward leg movement during marching exercises as illustrated in FIG. 3.

It should also be noted that the shoulder straps 24 include a plurality of attachment holes 28 for selectively positioning the shoulder laterally or longitudinally to provide for proper adjustment of the carrier frame 12 to the body of an individual wearer. As shown in the preferred embodiment the distal ends 40 of the shoulder straps 24 are rounded to provide a more comfortable fit for the wearer.

Figure 8:
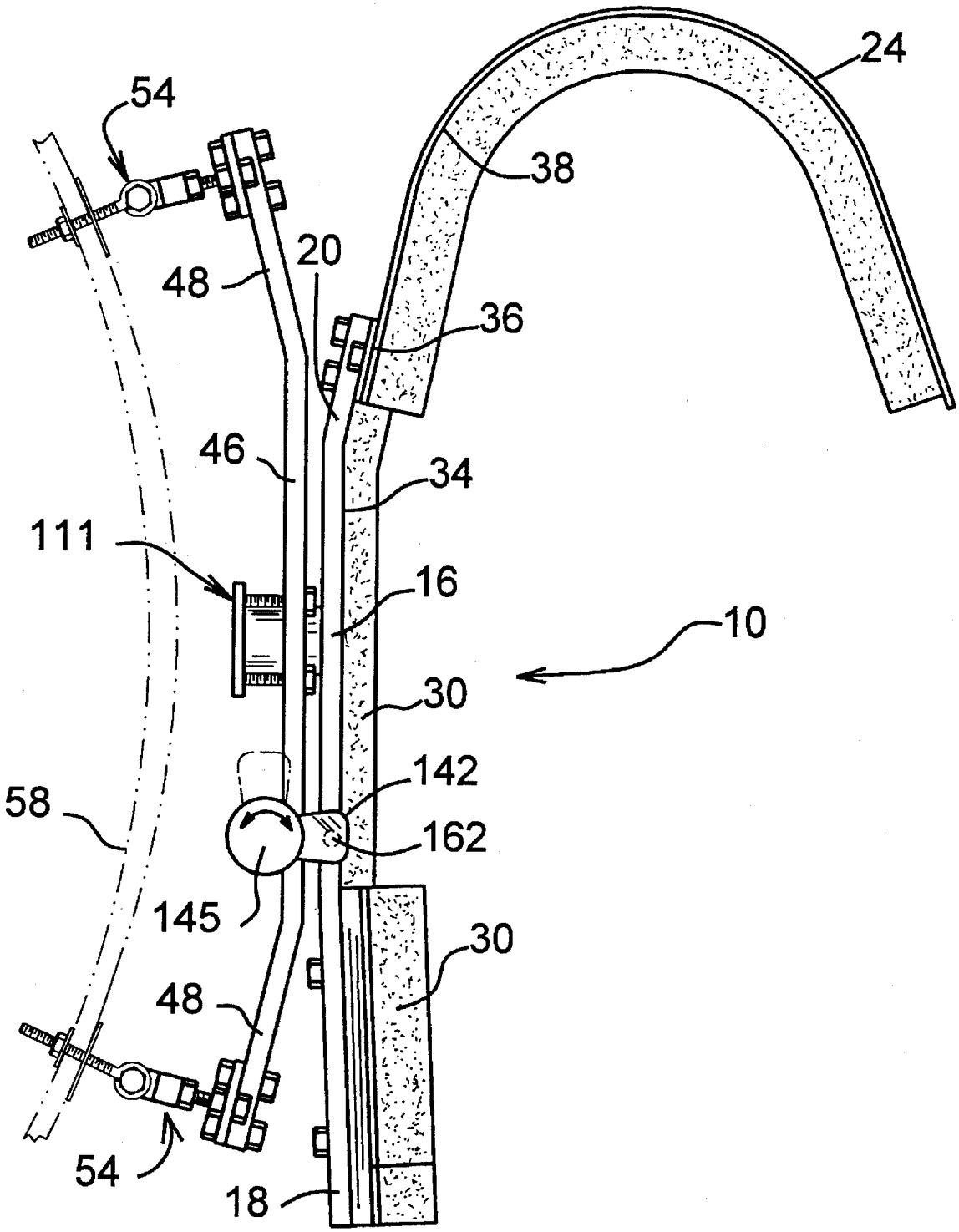
FIG. 8 is a side elevational view of the spinning drum carrier showing the latching mechanism holding the drum in a selected stationary position and the drum and the free rotating position of the latch mechanism in phantom lines.
Figure 9:
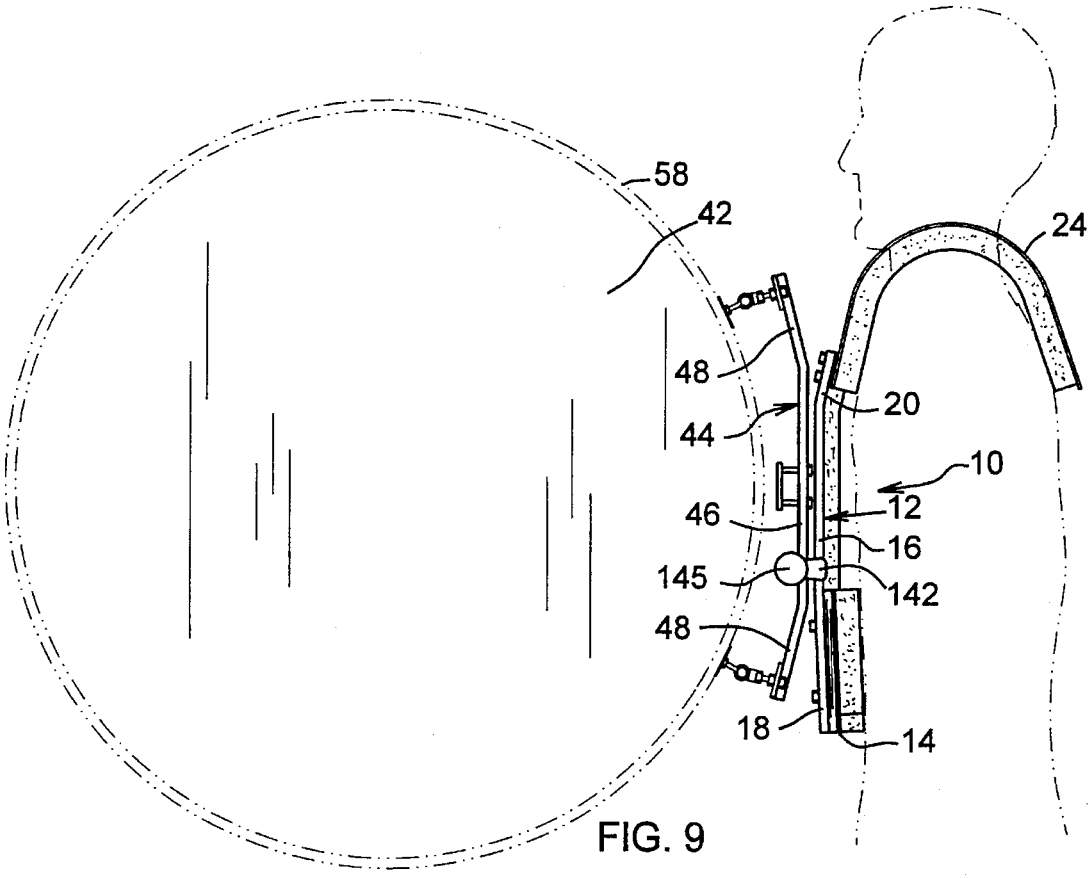
FIG. 9 is a side elevational view of the spinning drum carrier shown in FIG. 8, depicting the user and drum in phantom lines.
Figure 10:
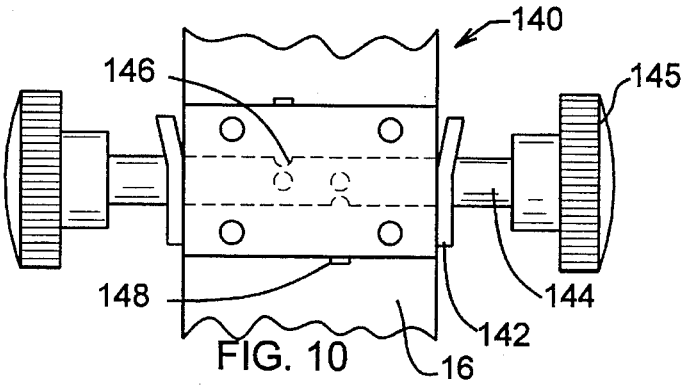
FIG. 10 is a front view of the latch mechanism attached to the main member and showing the tabs rotated upward in the detent position and showing veliers and aligned depressions therefor in phantom lines.

As best shown in FIGS. 8 and 9, a drum 42 is removably and adjustably attached to an "I-shaped" drum support frame 44 including a longitudinal main member 46 having angled end portions 48 extending outwardly away from the user to facilitate the curvature of the drum 42. A pair of spaced apart lateral drum holding members 50 sized according to the width of the drum 42 are removably and adjustably mounted normal to the angled end portions 48 of the longitudinal main member 46. In the preferred embodiment, the longitudinal main member 46 and lateral drum holding members 50 are fastened together by bolts 52 extending through selected aligned holes 28; however, it is contemplated that the "I-shaped" drum support frame 44 could be fastened together by welding or formed from a single integral piece by a molding process.

Adjusting the length of the attachment means at the bottom or top changes the center of gravity of the drum 42 and provides for a change in the balance with respect to the horizontal axis, and adjusting the length of the attachment means on the sides provides a means for balancing the drum in the vertical axis. Therefore, the present invention provides a means of balancing the spinning drum 42 in both the vertical and horizontal axis.

Figure 4:
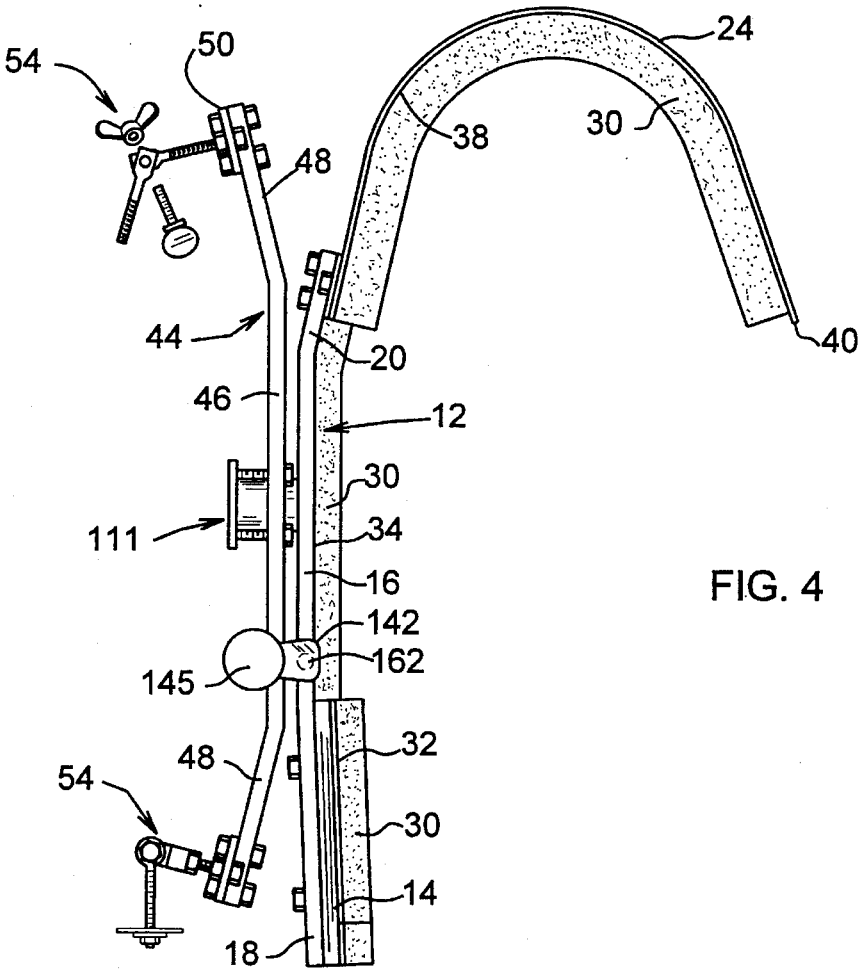
FIG. 4 is a side elevational view spinning drum carrier of FIG. 1.
Figure 5:
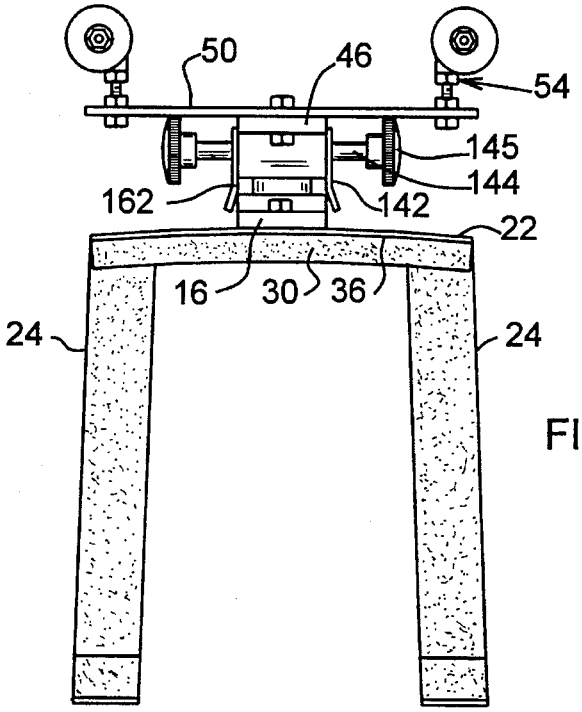
FIG. 5 is bottom plan view spinning drum carrier of FIG.
Figure 6:
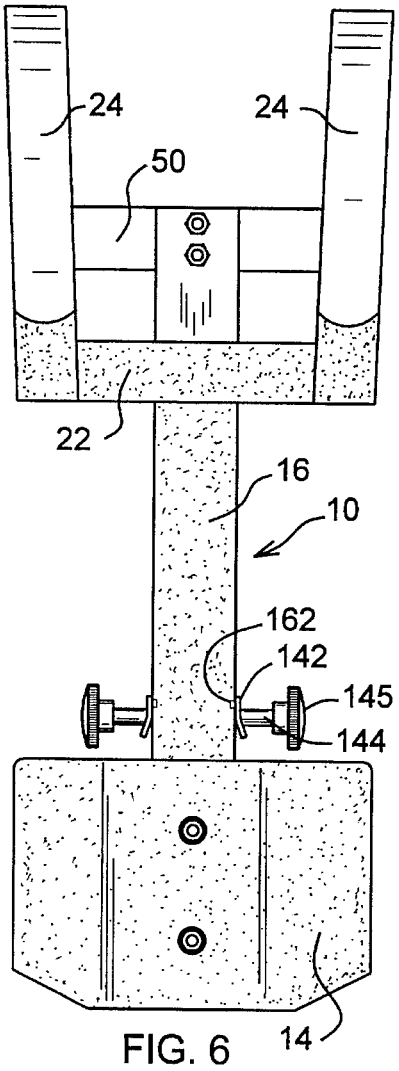
FIG. 6 is a rear elevational view spinning drum carrier of FIG. 1.
Figure 7:
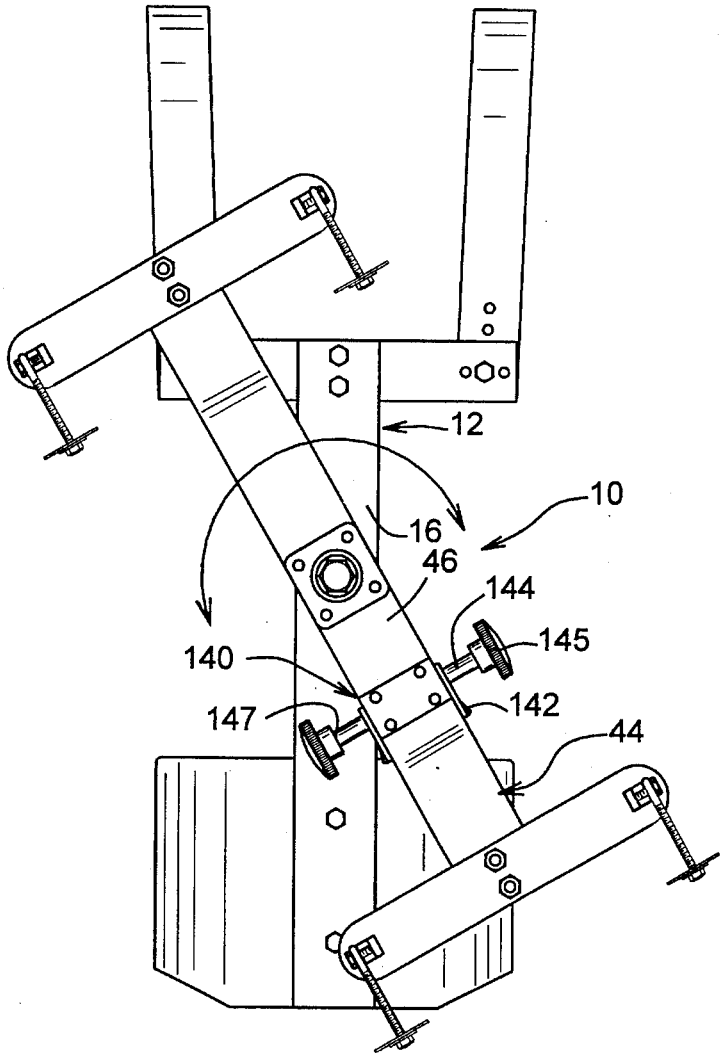
FIG. 7 is a front elevational view of the spinning drum carrier showing the drum support frame rotatably offset with respect to the carrier frame.

More particularly, the adjustable drum attachment means, such as rotating swivel hooks 54 as shown in FIGS. 1, 4, and 8 extend from the distal ends 56 of the lateral drum holding members 50 to the rim 58 of the drum 42. The swivel hook 54 extends through a hole (not shown) in the drum rim 58 and is held in cooperative engagement by a washer 60 and nut 62 removably attached to the swivel hook 54.

A preferred alternate embodiment of an adjustable drum attachment means is shown in FIGS. 1 and 15–18. The adjustable drum attachment means comprises a swivel knob assembly 63. As best shown in FIGS. 15–18, the swivel knob assembly 63 includes a clamping knob 64 having a threaded interior conduit 66 and an end-hole 68 therethrough having a smaller diameter than the threaded interior conduit 66. A screwball 70 is formed from a ball 71 having a hole 72 (not shown) therein is threadably engaged with a threaded rod screw 74 connected to the rim 58. A ball seat 76 having a concave end 78 and threaded sidewalls 80 threadably engages the interior conduit 66 of the clamping knob 64 for biasing the ball seat 76 against the anterior surface 82 of the clamping knob 64. A rod 84 movably attached to the drum distal end 56 of the lateral drum holding member 50, threadably engages interior threads 86 formed in the ball seat 76 opposite the concave end 78. A nut 88 biases the rod 86 against the ball seat 76 to prevent loosening of the rod 86. The drum 42 can then be removed by simply loosening the nut 86 and unscrewing the ball seat 76 from the clamping knob 64 which remains with the carrier frame 12.

A second alternate embodiment of an adjustable drum attachment means is shown in FIG. 4 whereby a flathead hanger screw assembly 89 is used to connect the lateral drum holding member 50 to the rim 58 of the drum 42.

The drum support frame 44 is rotatably connected to the carrier frame 12 of the spinning drum carrier 10 by a spindle assembly 111 having bushings 111(*a*) or bearings 111(*b*) as shown in FIGS. 19–23.

Figure 19:
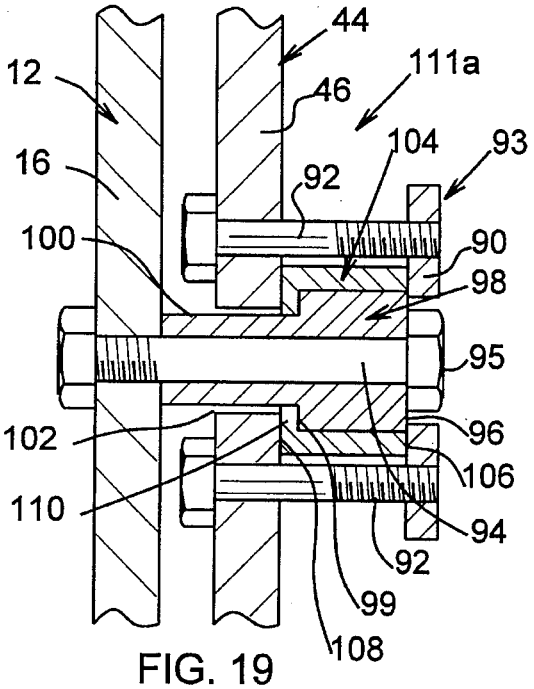
FIG. 19 is a cutaway side view of the spindle using a coaxial bushing assembly of one embodiment of the present invention.
Figure 20:
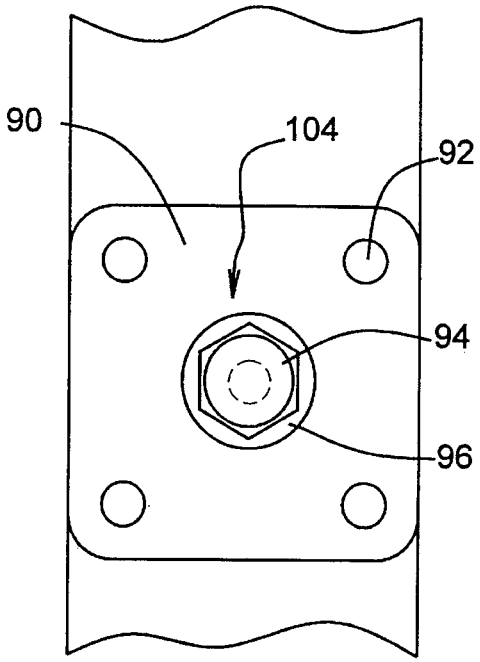
FIG. 20 is a end view of the end plate of the spindle assembly of the present invention.

As shown in FIGS. 19 and 20, the spindle assembly 111(*a*) consists of bushing which is held in place by a plate 90 securely fastened to the surface of the drum support frame 44 facing the drum 42 by screws 92. More specifically, FIG. 19 illustrates a coaxial bushing arrangement 93 having a central bolt 94 having a head 95 in contact with a first end 96 of a first cylindrical inner bushing 98 extending coaxially around the bolt 94. The second end 100 of the inner bushing 98 is formed having a reduced diameter forming a step 99. The reduced diameter second end 100 extends through a hole 102 formed through the longitudinal main member 46 of the drum support frame 44. The bolt 94 immovably biases the second end 100 of the first inner bushing 98 against the surface of the vertical support member 16. Moreover, a second cylindrical outer bushing 104 extends coaxially around the first inner bushing 98. The first end 106 of the second outer bushing 104 is held immovably against the plate 90 by the screws 92 extending into the longitudinal main member 46 of the drum support frame 44, thereby holding the second end 108 of the second outer bushing 104 immovably against the longitudinal main member 46. The second end 108 is formed having a flange 110 of reduced diameter in cooperative rotating engagement with the step of the first inner bushing 96 to minimize axial play along the horizontal axis.

Figure 21:
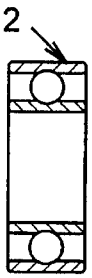
FIG. 21 is a side view showing a single row radial bearing for use in the spindle of another embodiment of the present invention.

A second embodiment of the spindle assembly 111(*b*) used in the present invention utilizes an improvement to minimize axial play by using a single row radial bearing 112 as shown in FIG. 21.

Figure 22:
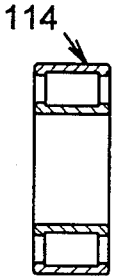
FIG. 22 is a side view showing a roller bearing for use in the spindle of another embodiment of the present invention.

A third embodiment of the spindle assembly 111(*b*) used in the present invention further improves the present invention by utilization of a roller bearing 114 as shown in FIG. 22.

A fourth and preferred embodiment of the spindle assembly 111(*b*) of the present invention further reduces play and provides smooth rotation of the drum by incorporating a novel double roll angular contact sealed bearing assembly 116 to rotatably connect the carrier frame 12 with the drum support frame 44 and virtually eliminate play. This novel feature is particularly important for a spinning drum carrier 10 in that the forces generated by a spinning base drum are significant and the wearer requires smooth controlled motion in order to control and manage spinning of a large drum.

More particularly, the spindle assembly 111(*b*) incorporating the double roll angular contact sealed bearing assembly 116 can be used with the single row radial bearing 112 or roller bearing 114.

Figure 23:
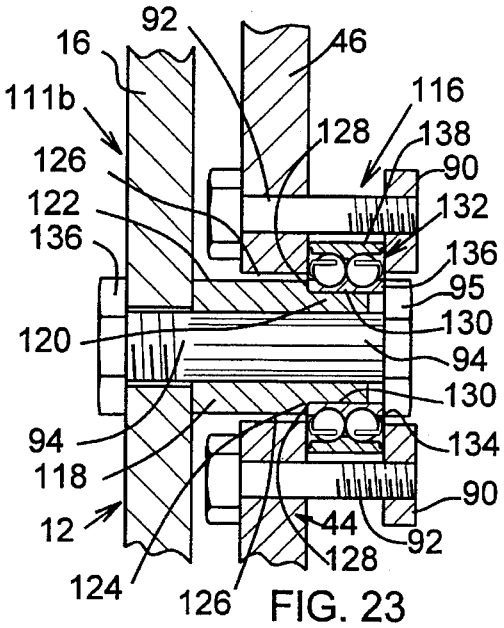
FIG. 23 is a side view showing a double roll angular contact sealed bearing assembly for use in the spindle of another embodiment of the present invention.

The double roll angular contact sealed bearing assembly 116 is best shown in FIG. 23. The assembly 116 incorporates a cylindrical spacer 118 having a uniform interior diameter adapted to complementary fit the external diameter of the bolt 94, and a first end 120 connected to a second end having a greater external diameter 122 forming a shoulder 124 thereinbetween. The second end 122 is biased against the vertical support member 16 of the carrier frame 12 and extends through and is held rotatably in a complementary sized opening 126 formed in the longitudinal main member 46 of the drum support frame 44. The shoulder 124 of the spacer 118 immovably biased against a first end 128 of the inner race 130 of the double roll angular contact sealed bearing 132. The opposite end 134 of the inner race 130 is held immovably by pressure exerted from the head 95 of the bolt 94 which is tightened by nut 136. The outer race 138 is immovably held against the longitudinal main member 46 of the drum support frame 44 by the plate 90 secured thereto by screws 92. This assembly provides for free rotation of the outer race 138 and longitudinal main member 46 of the drum support frame 44 with respect to the vertical support member 16 of the carrier frame 12.

A clamping or latch mechanism 140 as best shown in FIGS. 1, 5, and 10–14 is mounted on the longitudinal main member 46 of the drum support frame 44 for cooperative engagement with the vertical support member 16 of the carrier frame 12 for providing a means to hold the drum 42 in a rigid stationary manner horizontally, vertically, or at a desired angle, as well to permit the drum to spin freely. The latch mechanism 140 includes a latch support assembly having a pair of spaced apart flanges 142 or tabs for holding the drum 42 motionless during routine use. The flanges 142 are attached to a rod or spindle 144 having knobs 145 extending from the distal ends 147 and having a plurality of shallow recesses or notches 146 formed at selected positions, preferably at 90 degrees which engage spring loaded ball bearings or preferably velier plungers 148 disposed within the latch attachment housing 150. The latch assembly 140 is unique in that it uses a rachet ball/recess means for holding the flanges 142 in the correct up or down position as the spindle 144 is rotated within the latch attachment housing 150.

Figure 24:
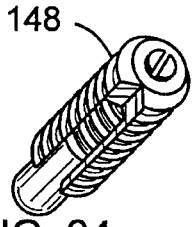
FIG. 24 is a perspective view showing a spring loaded velier used in the latch assembly of the present invention.
Figure 25:
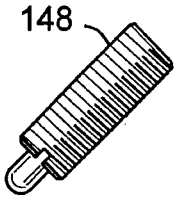
FIG. 25 is a side view showing the spring loaded velier of FIG. 24.
Figure 26:
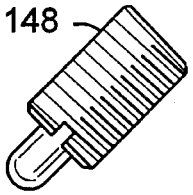
FIG. 26 is a side view showing a shorter spring loaded velier.

In the preferred embodiment shown in FIGS. 24–26, biasing means, more particularly, spring plungers or spring loaded veliers 148 having threaded outer surfaces are spaced apart at selected positions extending radially inwardly toward the spindle 144 extending through the exterior surface of the housing 150 and pressed or threadedly engaged with a threaded inner surface or throughbore formed within the housing 150.

The veliers 148 are readily available and can be ordered in a variety of sizes, shapes, and lengths from various manufacturer's such as JERGENS, INC.'s, *Jergen's Tooling Components*. The veliers 148 may also have nylon or other plastic types of locking elements inserted within the threads for more secure fastening. FIG. 24 shows a cut-away view of a typical spring loaded velier 148 showing a tubular body having a threaded outer surface and internal bore having a rotatable and axially moveable hardened steel plunger extending outward from the exterior of the body forming the tip. A portion of the plunger is retained within the bore by a radial lip in cooperative engagement with the bore. A spring is shown in cooperative engagement with the end of the plunger and the side walls of the velier bore. A slot or hex drive is formed in the head of the velier 148. The velier 148 is simply screwed into the housing 150 so that the plunger 148 is in cooperative engagement with the spindle 144.

Figure 11:
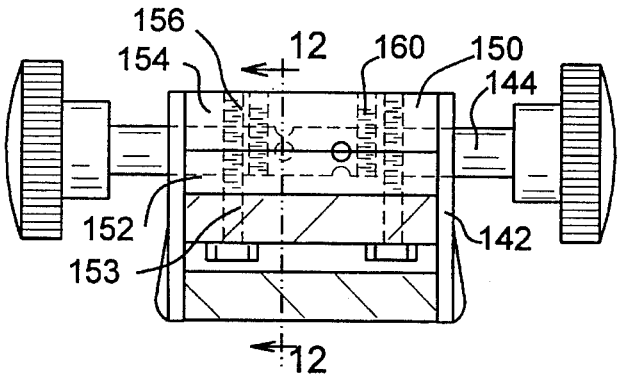
FIG. 11 is a top view of the latch mechanism showing the taps positioned in the locking position and the plungers of the veliers engaging the corresponding depressions therefor.
Figure 12:
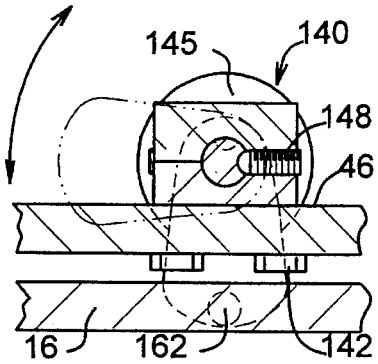
FIG. 12 is a cross-sectional view along lines 12—12 showing the plunger of a velier in engagement with the corresponding depression or notch.
Figure 13:
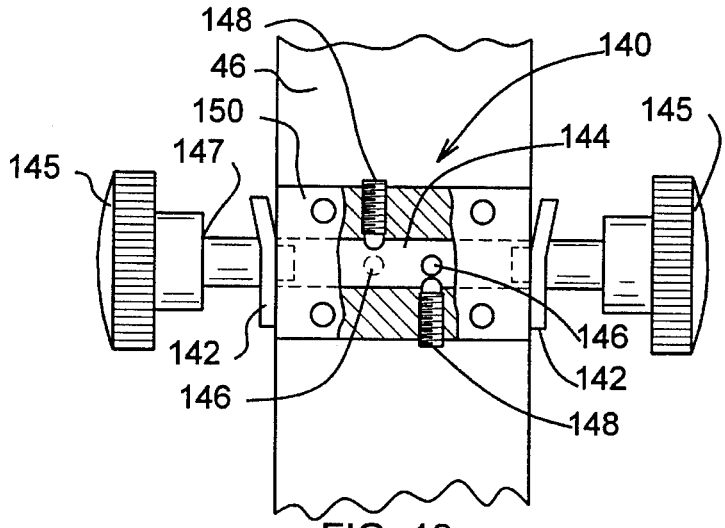
FIG. 13 is a front cutaway view of the latch mechanism shown in FIG. 10 showing the tabs rotated upward in the detent position and showing veliers and aligned depressions.
Figure 14:
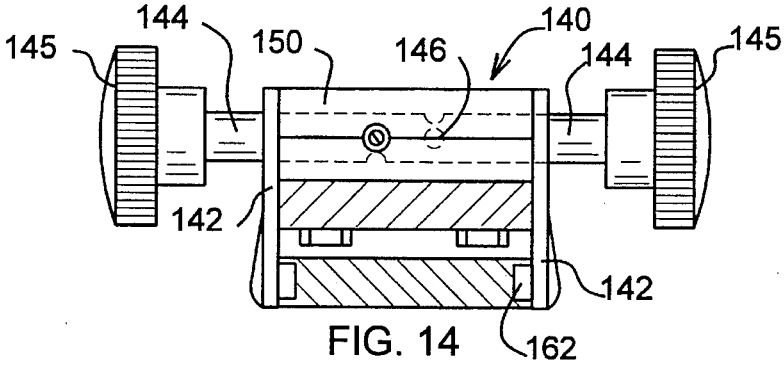
FIG. 14 is a top view of the latch mechanism of FIG. 12 showing latch shock absorbers extending outwardly from the drum support frame positioned in the locking position engaging the latch tab.
Figure 15:
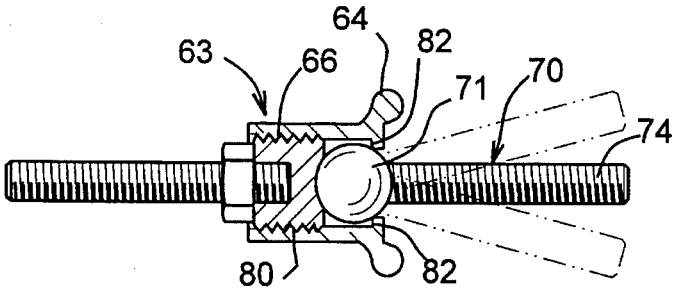
FIG. 15 is a side view showing an adjustable drum attachment means consisting of a swivel knob assembly.
Figure 16:
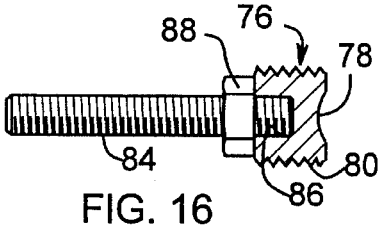
FIG. 16 is a side view showing the ball seat of the swivel knob assembly of FIG. 15.
Figure 17:
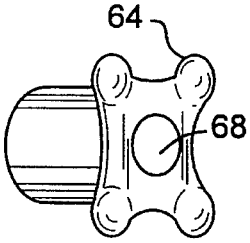
FIG. 17 is a side view showing the clamping knob of the swivel knob assembly of FIG. 15.
Figure 18:
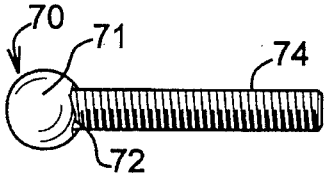
FIG. 18 is a side view showing the screwball of the swivel knob assembly of FIG. 15.

As best shown in FIGS. 11 and 14, the latch attachment housing 150 is a split assembly having a first section 152 having a plurality of throughbores 153 therethrough for accommodating screws for removable attachment to a second thicker section 154 having threaded throughbores 156, whereby screws 158 extend through the throughbores 154 and threaded throughbores and threadably engage threaded throughbores (not shown) formed in the surface of the longitudinal main member 46 for attachment thereto. Moreover, smaller screws 160 are used to join the first housing section 152 to the second section 154.

The tabs or flanges 142 have one side curved outwardly to facilitate rotation of the spindles 144 to the engaged or to the detent position. Moreover, as shown in FIGS. 4, 6, 8, 12, and 14, shock absorbers 162 formed from resilient cushioning material such as rubber prevent rattle and vibration of the flanges 142 against the vertical support member 16 and aid in stopping the flanges 142 at the correct position by resisting over rotation of the flanges 142. Thus, to hold the drum 42 stationary simply turn the knobs 145 to 90 degrees to engage the latch 140.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A spinning drum carrier for carrying and rotatably positioning a drum having a round curvature and rims around the periphery thereof, comprising:

a carrier frame including a curved abdomen support plate attached to a vertical support member, said vertical support member being curved inwardly slightly at the bottom end toward the wearer and being angled inwardly at the top end toward the wearer, said vertical support member having a removably and adjustably attached lateral support bar attached at the top end thereof and normal thereto, said lateral support bar including a pair of shoulder strap support members adjustably attached to respective distal ends thereof for fitting over the shoulders of a wearer to support said drum and said spinning drum carrier;

a drum support frame including a longitudinal main member having a straight center section and angled end portions extending outwardly away from the wearer to conform to the curvature of the drum, said longitudinal main member including a pair of spaced apart drum holding members mounted normal to the distal ends respectively of said longitudinal main member, and having adjustable drum attachment means extending from the distal ends of each of said drum holding members and adapted to engage the drum rims for holding the rims to the support frame;

a spindle assembly rotatably connecting said drum support frame and said carrier frame; and a latching mechanism removably mounted to said drum support frame providing a means for selectively allowing the support frame to rotate relative to said carrier frame.

2. The spinning drum carrier of claim 1, wherein said spindle assembly includes a coaxial bushing.

3. The spinning drum carrier of claim 1, wherein said spindle assembly includes a single row radial bearing.

4. The spinning drum carrier of claim 1, wherein said spindle assembly includes a roller bearing.

5. The spinning drum carrier of claim 1, wherein said spindle assembly includes a double roll angular contact sealed bearing.

6. The spinning drum carrier of claim 1, said adjustable drum attachment means comprises a swivel knob assembly for swiveling and adjusting the length of said adjustable drum attachment means, comprising:

a clamping knob having a threaded interior conduit and an end-hole therethrough having a smaller diameter than said threaded interior conduit forming an anterior surface between said threaded interior conduit and said end hole;

a screwball comprising a ball having a distal end and a front end attached to a threaded rod screw connecting to the distal end of said lateral drum holding member or said drum rim;

a ball seat having a concave end and threaded sidewalls connected to a threaded rod removably secured to said drum rim or lateral drum holding member, said ball seat threadably engaging said threaded interior conduit of said clamping knob, wherein rotating said ball seat against the distal end of said screwball biases said front end of said screwball against said anterior surface of said clamping knob.

7. A spinning drum carrier for carrying and rotatably positioning a drum having a round curvature and rims around the periphery thereof, comprising:

a carrier frame including an abdomen support plate attached to a vertical support member, said vertical support member having a removably and adjustably attached lateral support bar attached at the top end thereof and normal thereto, said lateral support bar including a pair of shoulder strap support members adjustably attached to respective distal ends thereof for fitting over the shoulders of a wearer to support said drum and said spinning drum carrier;

a drum support frame including a longitudinal main member having a straight center section and end portions extending outwardly away from the wearer to conform to the curvature of the drum, said longitudinal main member including a pair of spaced apart drum holding members mounted normal to respective distal ends of said longitudinal main member, and having adjustable drum attachment means extending from the distal ends of each of said drum holding members and adapted to engage the drum rims for holding the rims to the support frame;

a spindle assembly rotatably connecting said drum support frame and said carrier frame; and a latching mechanism removably mounted to said drum support frame providing a means for selectively allowing the support frame to rotate relative to said carrier frame.

8. The spinning drum carrier of claim 7, wherein said spindle assembly includes a coaxial bushing.

9. The spinning drum carrier of claim 7, wherein said spindle assembly includes a single row radial bearing.

10. The spinning drum carrier of claim 7, wherein said spindle assembly includes a roller bearing.

11. The spinning drum carrier of claim 7, wherein said spindle assembly includes a double roll angular contact sealed bearing.

12. The spinning drum carrier of claim 7, said adjustable drum attachment means comprises a swivel knob assembly for swiveling and adjusting the length of said adjustable drum attachment means, comprising:

a clamping knob having a threaded interior conduit and an end-hole therethrough having a smaller diameter than said threaded interior conduit forming an anterior surface between said threaded interior conduit and said end hole;

a screwball comprising a ball having a distal end and a front end attached to a threaded rod screw connecting to the distal end of said lateral drum holding member or said drum rim;

a ball seat having a concave end and threaded sidewalls connected to a threaded rod removably secured to said drum rim or lateral drum holding member, said ball seat threadably engaging said threaded interior conduit of said clamping knob, wherein rotating said ball seat against the distal end of said screwball biases said front end of said screwball against said anterior surface of said clamping knob.

13. A spinning drum carrier for carrying and rotatably positioning a drum having a round curvature and rims around the periphery thereof, comprising:

a carrier frame including an abdomen support plate attached to a vertical support member, said vertical support member having a lateral support bar attached at the top end thereof and normal thereto, said lateral support bar including a pair of shoulder strap support members attached to respective distal ends thereof for fitting over the shoulders of a wearer to support said drum and said spinning drum carrier;

a drum support frame including a longitudinal main member including a pair of spaced apart drum holding members mounted normal to respective distal ends of said longitudinal main member, and having drum attachment means extending from the distal ends of each of said drum holding members adapted to engage the drum rims for holding the rims to the support frame;

a spindle assembly including a double roll angular contact sealed bearing for rotatably connecting said drum support frame and said carrier frame; and means for selectively allowing the support frame to rotate relative to said carrier frame.

14. The spinning drum carrier of claim 13, wherein said means for selectively allowing the support frame to rotate relative to said carrier frame is a latching mechanism removably mounted to said drum support frame.

15. The spinning drum carrier of claim 14, wherein said latch mechanism comprises:

a latch support assembly having a pair of spaced apart flanges for holding the drum motionless, said flanges attaching to a spindle having a plurality of shallow recesses formed at selected positions therein for mating with at least one spring loaded plunger means secured within a latch attachment housing, wherein said plunger means cooperatively engages said recess for holding said flanges in the correct up or down position as said spindle is rotated within said latch attachment housing.

16. The spinning drum carrier of claim 13, wherein said vertical support member extends inwardly slightly at the bottom end toward the wearer and extends inwardly at the top end toward the wearer.

17. The spinning drum carrier of claim 13, wherein said longitudinal main member of said drum support frame defines a straight center section and end portions extending outwardly away from the wearer to conform to the curvature of the drum.

18. The spinning drum carrier of claim 13, wherein said abdomen support plate is curved.

19. The spinning drum carrier of claim 13, wherein said drum attachment means are adjustable.

20. The spinning drum carrier of claim 19, said adjustable drum attachment means comprises a swivel knob assembly for swiveling and adjusting the length of said adjustable drum attachment means, comprising:

a clamping knob having a threaded interior conduit and an end-hole therethrough having a smaller diameter than said threaded interior conduit forming an anterior surface between said threaded interior conduit and said end hole;

a screwball comprising a ball having a distal end and a front end attached to a threaded rod screw connecting to the distal end of said lateral drum holding member or said drum rim;

a ball seat having a concave end and threaded sidewalls connected to a threaded rod removably secured to said drum rim or lateral drum holding member, said ball seat threadably engaging said threaded interior conduit of said clamping knob, wherein rotating said ball seat against the distal end of said screwball biases said front end of said screwball against said anterior surface of said clamping knob.

* * * * *